US011761280B2

(12) United States Patent
Hern et al.

(10) Patent No.: US 11,761,280 B2
(45) Date of Patent: Sep. 19, 2023

(54) INTERLOCK FOR A DOWNHOLE TOOL

(71) Applicants: Gregory Hern, Porter, TX (US); Christopher Hern, Porter, TX (US)

(72) Inventors: Gregory Hern, Porter, TX (US); Christopher Hern, Porter, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 5 days.

(21) Appl. No.: 17/536,434

(22) Filed: Nov. 29, 2021

(65) Prior Publication Data

US 2023/0167698 A1 Jun. 1, 2023

(51) Int. Cl.
*E21B 23/06* (2006.01)

(52) U.S. Cl.
CPC ..... *E21B 23/06* (2013.01)

(58) Field of Classification Search
CPC ..... E21B 23/06
See application file for complete search history.

(56) References Cited

U.S. PATENT DOCUMENTS 3,135,328 A * 6/1964 Cherry ..... E21B 23/06 166/125
3,223,170 A * 12/1965 Mott ..... E21B 43/10 166/212
4,216,827 A * 8/1980 Crowe ..... E21B 33/1295 166/182
4,285,400 A * 8/1981 Mullins, II ..... E21B 33/1295 166/120
4,311,195 A * 1/1982 Mullins, II ..... E21B 33/1295 166/182
4,754,814 A * 7/1988 Jordan, Jr. ..... E21B 33/1295 166/134
5,810,082 A * 9/1998 Jordan, Jr. ..... E21B 33/1295 166/120
7,896,067 B2 3/2011 Rayssiguier et al.
(Continued)

FOREIGN PATENT DOCUMENTS

EP 2836665 B1 11/2019
WO 2017204785 A1 11/2017

OTHER PUBLICATIONS

International Search Report and Written Opinion dated Mar. 17, 2023 in PCT/US2022/049254; 10 pages.

*Primary Examiner* — Steven A MacDonald
(74) *Attorney, Agent, or Firm* — CANTOR COLBURN LLP

(57) ABSTRACT

A downhole tool including a mandrel having a first surface, and opposing second surface defining a flow path, a lock support zone provided one of the first and second surfaces, and a passage extending between the flow path and the first surface. A tool is supported on one of the first and second surfaces. A sleeve is selectively shiftable on the one of the first and second surfaces into engagement with the tool. The sleeve includes a first surface portion and a second surface portion. The second surface portion includes a latch section. A lock system is arranged between the first surface and the second surface portion in the lock support zone. The lock system includes a lock member selectively supporting a lock element in the latch section. The lock element constrains movement of the sleeve.

18 Claims, 6 Drawing Sheets

(56) References Cited

U.S. PATENT DOCUMENTS

| | | | | |
|---|---|---|---|---|
| 2009/0266556 | A1* | 10/2009 | Swenson | E21B 23/02<br>166/373 |
| 2018/0258726 | A1 | 9/2018 | Evert, Jr. et al. | |
| 2020/0149363 | A1 | 5/2020 | Cho et al. | |

* cited by examiner

INTERLOCK FOR A DOWNHOLE TOOL

In the resource recovery industry tools are run into a wellbore for a variety of operations. Tools can include sliding sleeves, anchors, slips, packers, production equipment, window cutting systems and the like. Tools may be run-in in a first configuration and then shifted to a second configuration to support a downhole operation. If the tool shifts from the first configuration to the second configuration prematurely, wellbore operations may be interrupted, or halted complete to run out the tool and reset.

Operators employ a variety of systems to prevent premature tool shifting. Tools may include hydraulic valves, locking sleeves, and/or shear elements that hold one member in place relative to another while being run in hole. During run-in operations, a tubular can bounce off of internal well surfaces, catch on joints, be exposed to hydrostatic pressure or be subject to any number of different accelerations and/or pressures. The different accelerations and/or pressures may cause a piston to shift, a shear pin to fracture or otherwise allow the tool to set despite taking prophylactic measures. Accordingly, the industry would welcome a tool locking system that was resistant to accelerations, vibrations, and pressure changes.

SUMMARY

Disclosed, in accordance with a non-limiting example, is a downhole tool including a mandrel having a first surface, and opposing second surface defining a flow path, a lock support zone provided one of the first and second surfaces, and a passage extending between the flow path and the first surface. A tool is supported on one of the first and second surfaces. A sleeve is selectively shiftable on the one of the first and second surfaces into engagement with the tool. The sleeve includes a first surface portion and a second surface portion. The second surface portion includes a latch section. A lock system is arranged between the first surface and the second surface portion in the lock support zone. The lock system includes a lock member selectively supporting a lock element in the latch section. The lock element constrains movement of the sleeve.

Also disclosed in accordance with a non-limiting example is a resource exploration and recovery system including a surface system and a subsurface system including a tubular string having a tool. The tool includes a mandrel having a first surface, and opposing second surface defining a flow path, a lock support zone provided on one of the first and second surfaces, and a passage extending between the flow path and the first surface. The tool is supported on one of the first and second surfaces. A sleeve is selectively shiftable on the one of the first and second surfaces into engagement with the tool. The sleeve includes a first surface portion and a second surface portion. The second surface portion includes a latch section. A lock system is arranged between the first surface and the second surface portion in the lock support zone. The lock system includes a lock member selectively supporting a lock element in the latch section. The lock element constrains movement of the sleeve.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
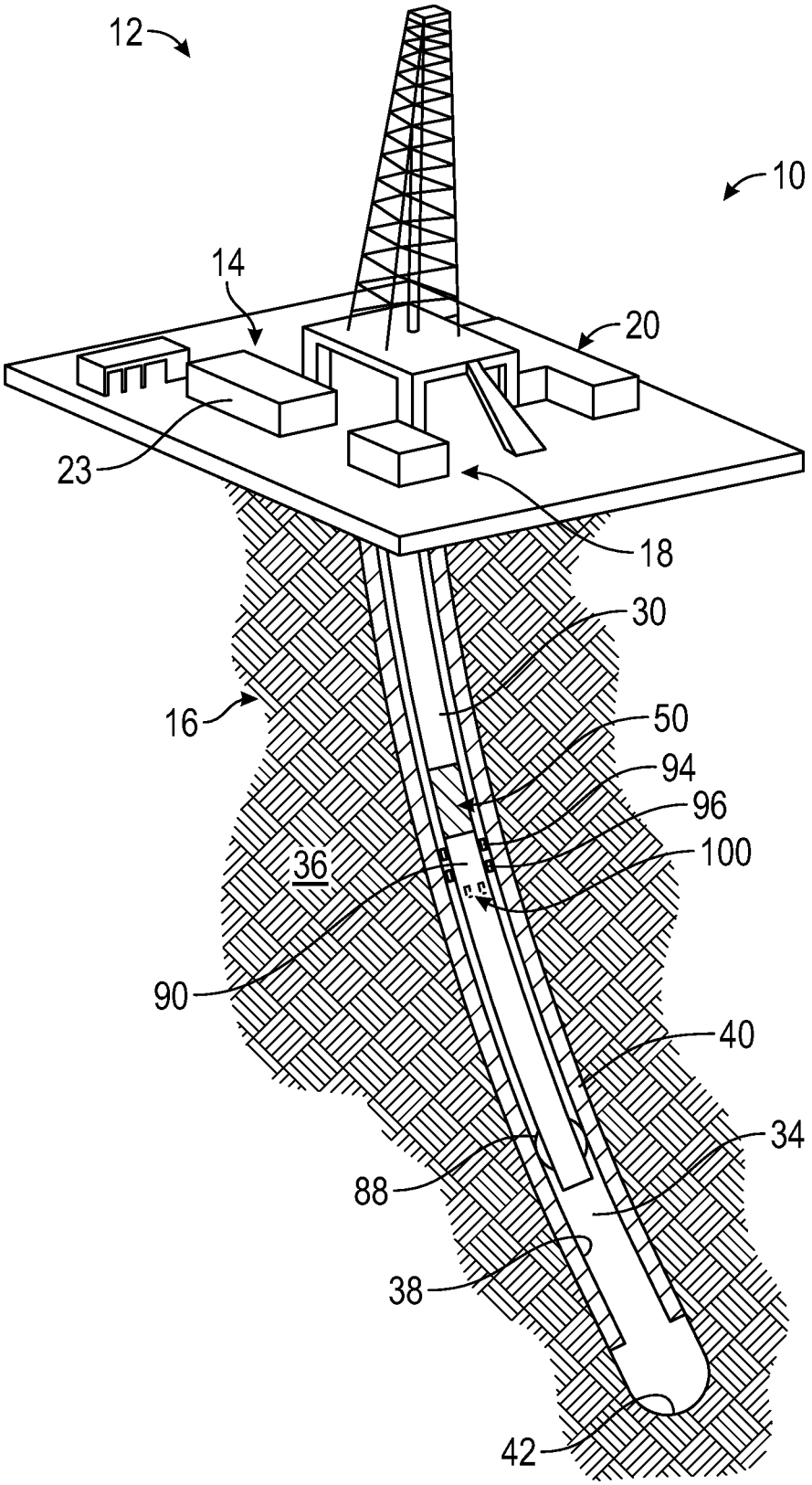
FIG. 1 depicts a resource exploration and recovery system including tool system having a locking mechanism, in accordance with a non-limiting example.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 12 which, in some environments, may take the form of a surface system 14 operatively and fluidically connected to a second system 16 which, in some environments, may take the form of a subsurface system.

First system 12 may include pumps 18 that aid in completion and/or extraction processes as well as fluid storage 20. Fluid storage 20 may contain a stimulation fluid which may be introduced into second system 16. First system 12 may also include a control system 23 that may monitor and/or activate one or more downhole operations. Second system 16 may include a tubular string 30 formed from a plurality of tubulars (not separately labeled) that is extended into a wellbore 34 formed in formation 36. Wellbore 34 includes an annular wall 38 that may be defined by a casing tubular 40 that extends from first system 12 towards a toe 42 of wellbore 34.

Figure 2:
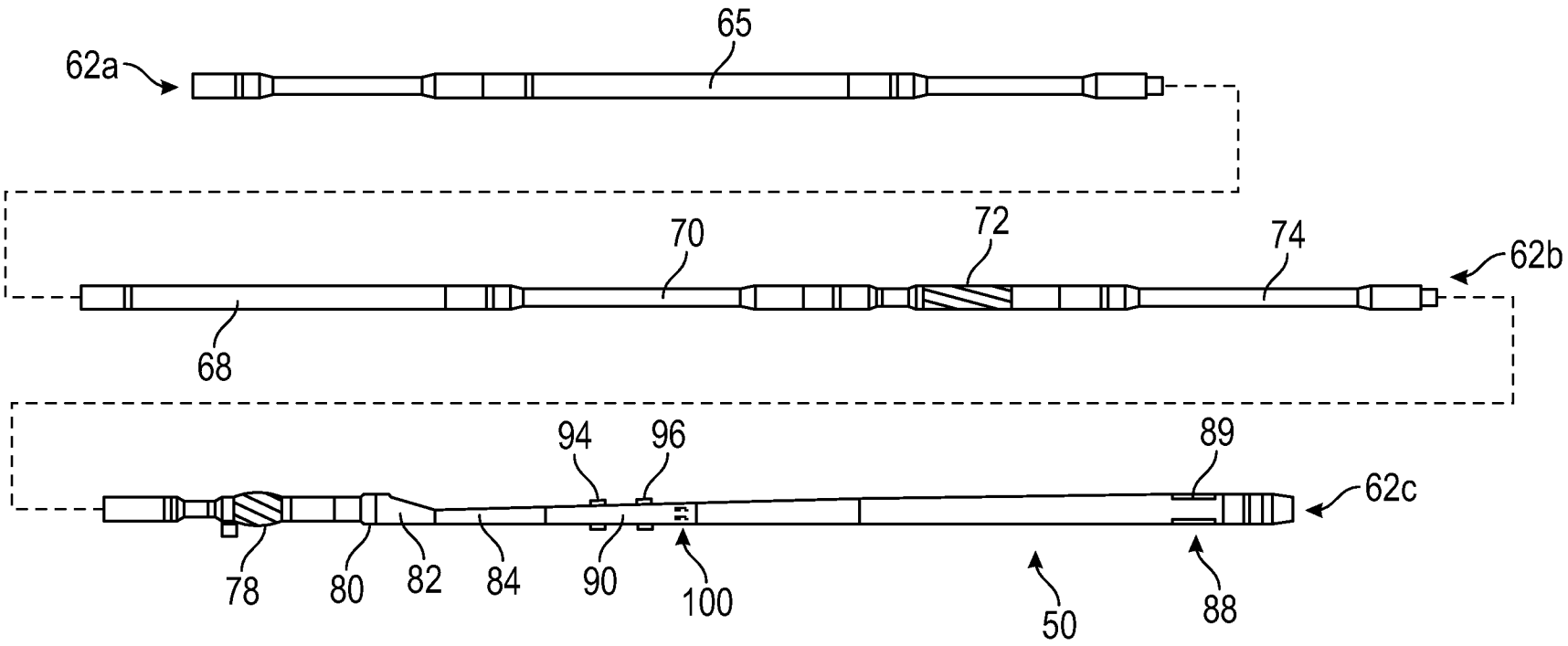
FIG. 2 depicts a work string including the tool system of FIG. 1, in accordance with a non-limiting example.

In accordance with an exemplary aspect, tubular string 30 may support a casing exit or window cutting system 50 as shown in FIG. 2. Window cutting system 50 is lowered to a selected depth, affixed to casing tubular 40, and activated to form a window. The window represents an opening in casing tubular 40 that allows a branch to be formed from wellbore 34. In the embodiment shown, window cutting system 50 is formed from a number of tubular segments 62*a*, 62*b*, and 62*c* as shown in FIG. 2. Each segment 62*a*, 62*b*, and 62*c* may be made up off-site and delivered to first system 12 for introduction into wellbore 34.

In an embodiment, first segment 62*a* may support a measurement while drilling (MWD) system 65 that includes various instrumentation systems which monitor window cutting operations. Second segment 62*b* may include a whipstock valve 68, a first flex joint 70, an upper watermelon mill 72, and a second flex joint 74. Third segment 62*c* may include a lower watermelon mill 78, a window mill 80, a whipstock connector 82, a whipstock 84, and an anchor 88 that may include one or more slips 89. Whipstock connector 82 serves as an interface between window mill 80 and whipstock 84 and may include a zonal isolation tool 90.

Figure 3:
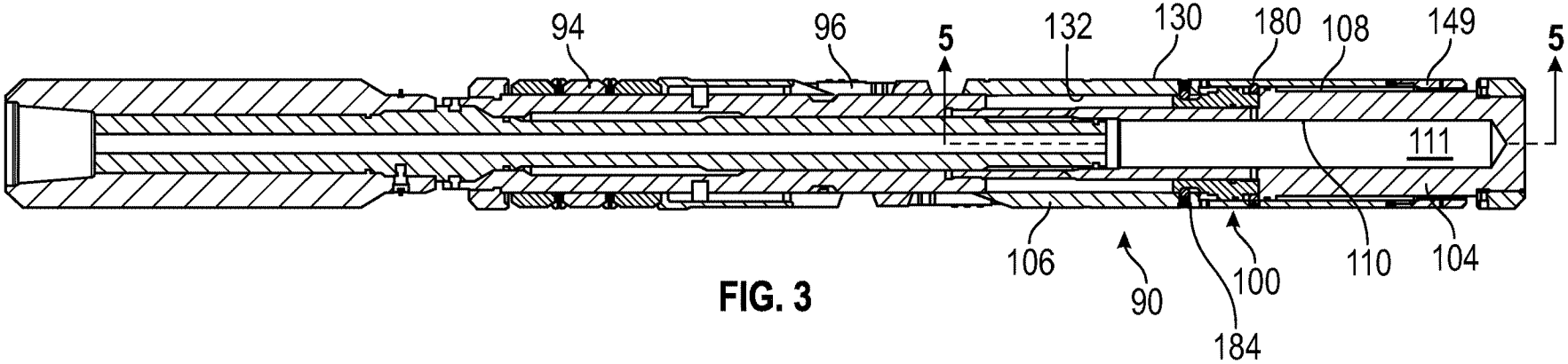
FIG. 3 is a cross-sectional side view of the tool system having the locking mechanism of FIG. 2 in a run-in-hole configuration, in accordance with a non-limiting example.
Figure 4:
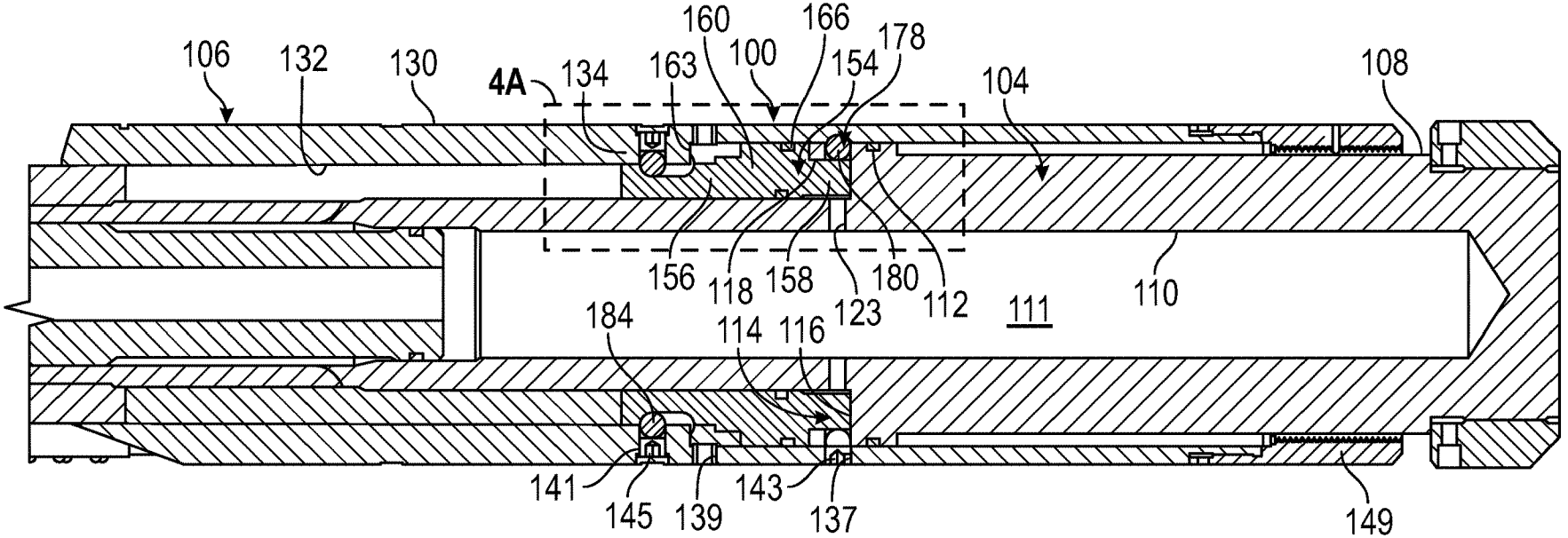
FIG. 4 is a detail view of the locking mechanism of FIG. 3, in accordance with a non-limiting example.
Figure 4A:
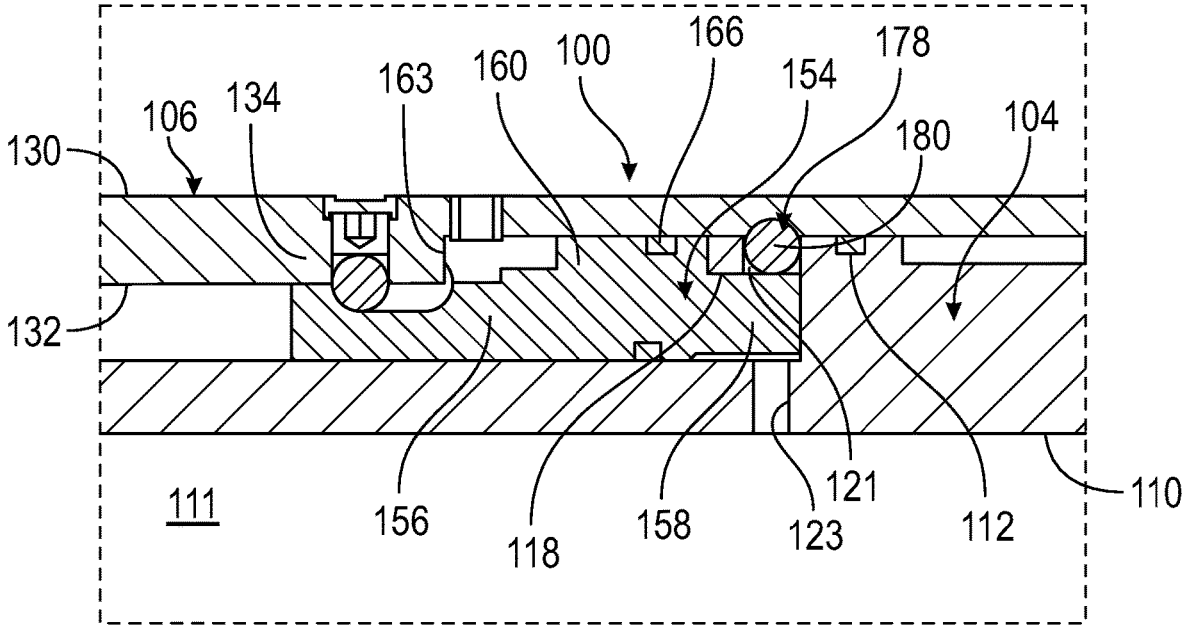
FIG. 4A is a detail view of the area indicated at 4A in FIG. 4.

Zonal isolation tool 90 includes packing elements 94 and a plurality of slips 96 that aid in setting packing elements 94. Zonal isolation tool 90 also includes a lock system 100 that prevents inadvertent setting of slips 96 and/or packing elements 94 as will be detailed herein. Referring to FIGS. 3, 4, and 4A and with continued reference to FIG. 2 zonal isolation tool 90 includes a mandrel 104 surrounded by a selectively shiftable setting sleeve 106. In a non-limiting example, mandrel 104 includes a first surface 108 that may be an outer surface and a second surface 110 that may be an inner surface. Second surface 110 defines a flow path 111 that may be internal to mandrel 104. A seal land 112 is formed on first surface 108. Seal land 112 supports a seat (not separately labeled) that abuts setting sleeve 106. At this point, it should be understood that while shown as being arranged on first surface 108, sleeve 106 may be arranged on second surface 110.

In a non-limiting example, a lock support zone 114 is positioned adjacent to seal land 112. First surface 108 includes a step region 116. In a non-limiting example, lock support zone 114 extends axially into step region 116 and defines an annular recess 118. A first opening 121 (FIG. 7) forms a passage that extends through first surface 108 into lock support zone 114. A second opening 123 forms a passage that extends from lock support zone 114 into flow path 111. Lock support zone 114 is fluidically connected to flow path 111 as will be detailed more fully herein.

In a non-limiting example, setting sleeve 106 includes a first surface portion 130 which may be an outer surface portion and a second surface portion 132 that may be an inner surface portion 132. Second surface portion 132 includes a step zone 134 axially spaced from lock support zone 114. A first opening portion(s) 137 extends though first surface portion 130 at lock support zone 114, a second opening portion(s) 139 extends through setting sleeve 106 at a first side of step zone 134 and a third opening portion(s) 141 extends through setting sleeve 106 at a second side of step zone 134. First opening portion(s) 137 is fitted with a first plug 143 and third opening portion(s) 141 are fitted with a second plug 145. Setting sleeve 106 also includes a latch section 147 at lock support zone 114. Latch section 147 may take the form of an annular groove (not separately labeled). Setting sleeve 106 is coupled to mandrel 104 by a body lock ring 149.

In accordance with a non-limiting example, lock system 100 includes a lock member 154 that may take the form of a selectively shiftable piston 156 having a first section 158 including a first diameter, a second section 160 having a second diameter that is greater than the first diameter, and a stepped region 163. A seal 166 is provided on second section 160. Seal 166 abuts second surface portion 132 of setting sleeve 106. A shear pin 169 (FIG. 5) extends through setting sleeve 106 and engages with stepped region 163 to constrain movement of piston 156.

Figure 5:
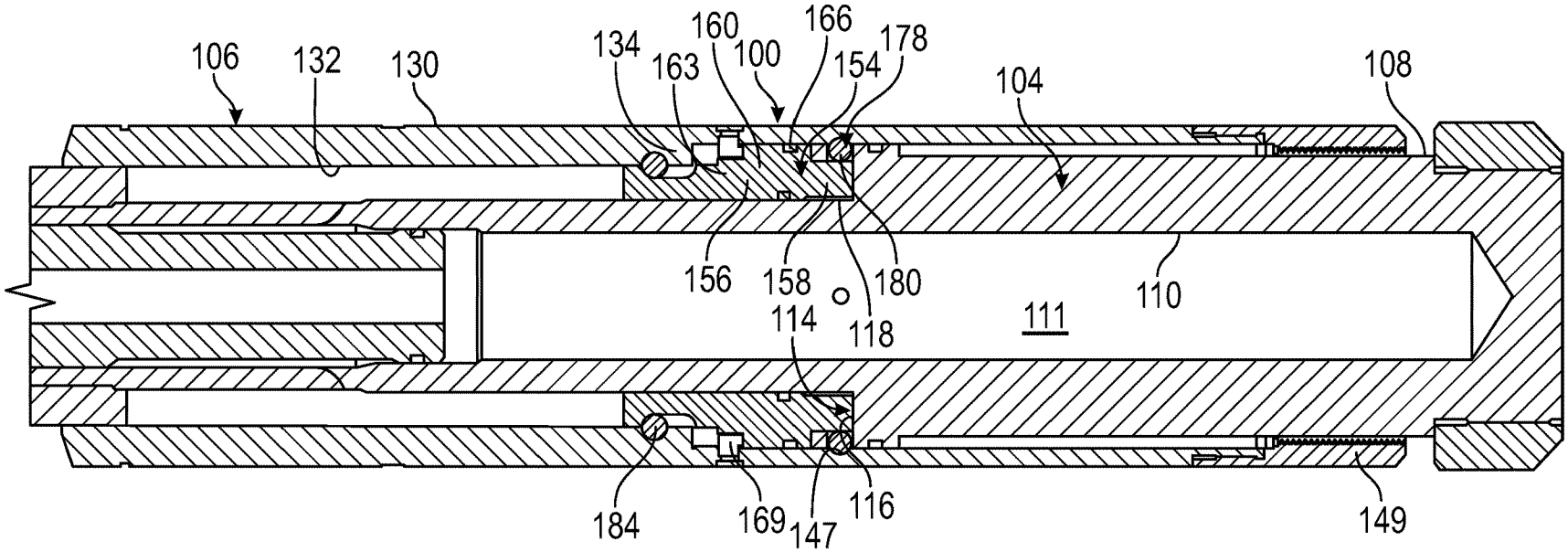
FIG. 5 is a cross-sectional view of the locking mechanism of FIG. 3 taken along the line 5-5, in accordance with a non-limiting example.

In a non-limiting example, a lock element 178, which may take the form of a ball bearing 180 selectively rests upon first section 158 of piston 156. Ball bearing 180 is arranged in first opening 121 and extends into latch section 147. When in latch section 147, ball bearing 180 prevents unintended movement of setting sleeve 106. Thus, in a run in hole configuration as shown in FIGS. 3-5, piston 56 is in an engaged position forcing ball bearing 180 into latch section 147 thereby preventing setting sleeve 106 from breaking shear pins 169 and unintentionally setting slips 96 and/or packing elements 94.

Figure 6:
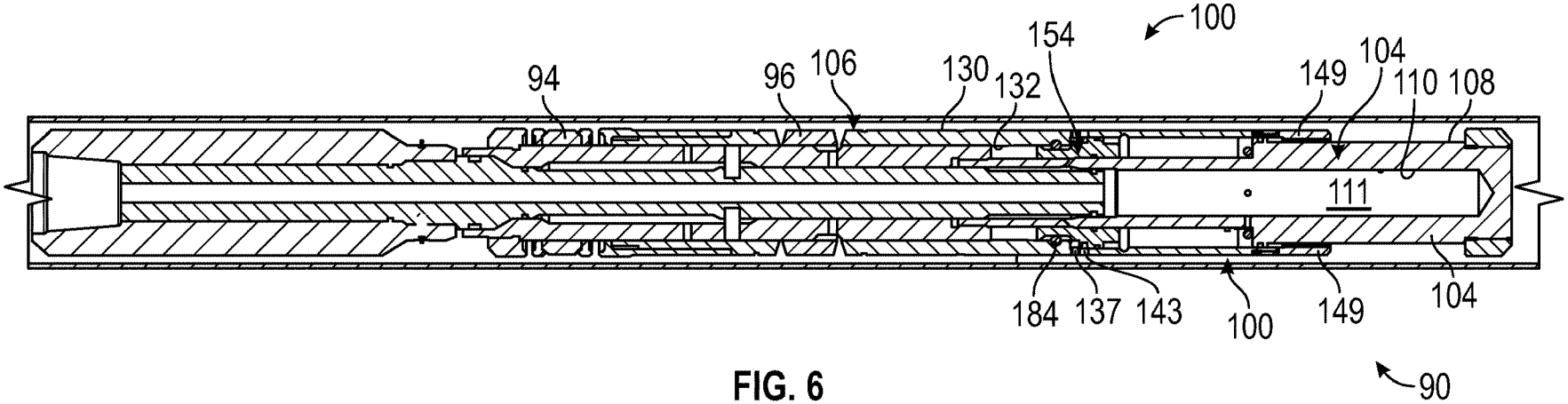
FIG. 6 is a cross-section view of the tool system of FIG. 3 in a second configuration, in accordance with a non-limiting example.
Figure 7:
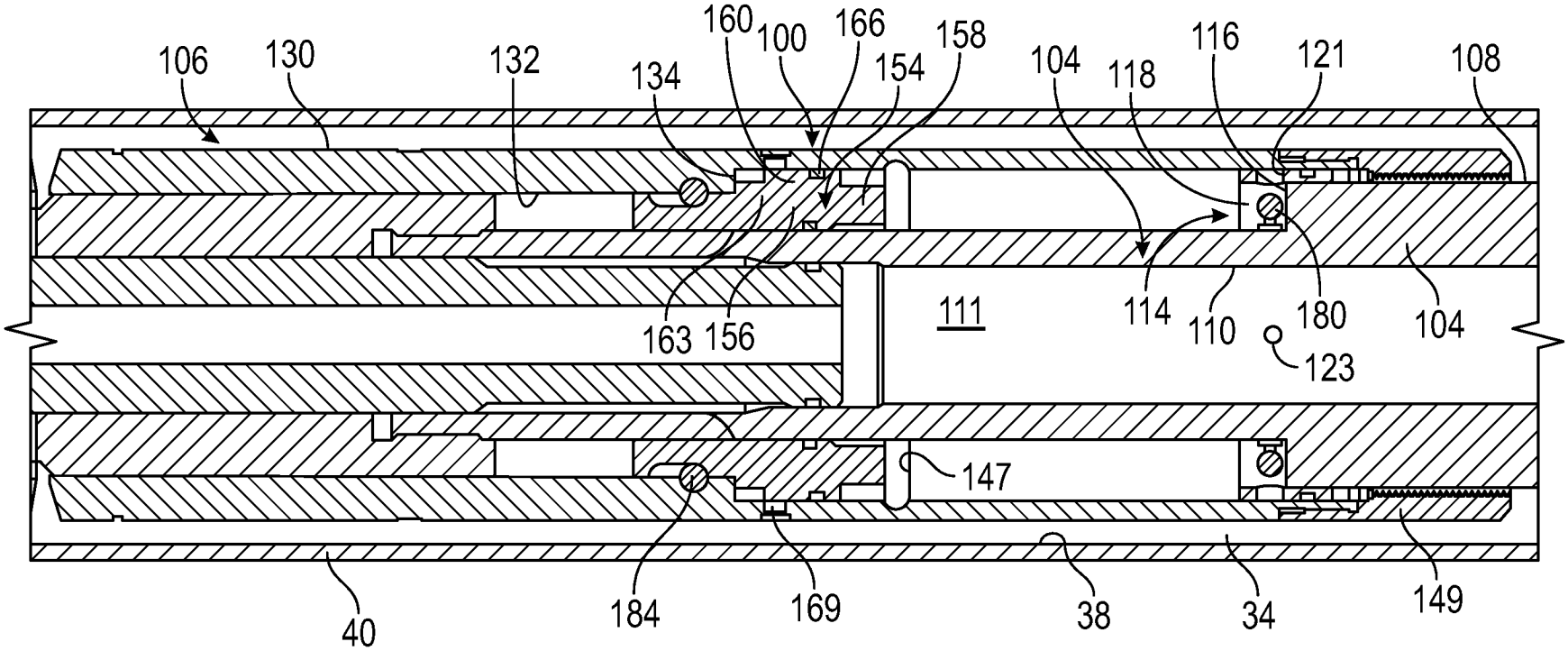
FIG. 7 is detail view locking mechanism of FIG. 6; in accordance with a not ng example.

When at a selected depth in wellbore 34, piston 156 is shifted to a disengaged position as shown in FIGS. 6 and 7 allowing ball bearing 180 to drop through first opening 121 away from latch section 147 and releasing setting sleeve 106. In a non-limiting example, piston 156 may be shifted by building pressure in flow path 111. The pressure acts on piston 156 through opening 123. The pressure forces piston 156 into shear pin 169. Shear pin 169 fractures allowing piston 156 to travel to the disengaged position. At this point, it should be understood that while described as building pressure in flow path 111 arranged internally of mandrel 104, in a non-limiting example, pressure may be built in a flow path that is external to mandrel 104 depending on component arrangement.

In one non-limiting example, piston 156 is constrained from moving further passed the disengaged position by an interaction between stepped region 163 and step zone 134. In a second non-limiting example, lock system 100 may include a second ball bearing 184 that provided in third opening portion 141 of setting sleeve 106. Second ball bearing 184 interacts with stepped region 163 to constrain movement of piston 156 and prevent movement towards first opening 137 allowing seal 166 to register with latch section 147 allowing packing element 94 to lose pressure. In a non-limiting example, piston 156 may take the form of a c-ring that extends partially annularly about mandrel 104 in lock support zone 114.

At this point, it should be understood that the non-limiting examples described herein can be employed to prevent movement of one portion of a tool relative to another portion of a tool until commanded to do so. The lock system relies on a lock element that is not easily dislodged and resists movement due to impacts on wellbore walls. Further, the use of lock element allow the tool to experience high axial loads without putting stress on shear elements that could fracture and lead to inadvertent setting. More specifically, the lock element reduces stress on shear elements until a selected hydraulic pressure is applied to set the tool. Finally, the lock system functions without contributing to diametric increases in the tool. Also, while shown as containing movement of an outer sleeve, the location of the selectively constrained member may vary. Further, the number and orientation of lock elements may vary.

Set forth below are some embodiments of the foregoing disclosure:

Embodiment 1. A downhole tool comprising: a mandrel including a first surface, and opposing second surface defining a flow path, a lock support zone provided one of the first and second surfaces, and a passage extending between the flow path and the first surface; a tool supported on one of the first and second surfaces; a sleeve selectively shiftable on the one of the first and second surfaces into engagement with the tool, the sleeve including a first surface portion and a second surface portion, the second surface portion including a latch section; and a lock system arranged between the first surface and the second surface portion in the lock support zone, the lock system including a lock member selectively supporting a lock element in the latch section, the lock element constraining movement of the sleeve.

Embodiment 2. The downhole tool according to any prior embodiment, wherein the lock member comprises a selectively shiftable piston arranged between the mandrel and the sleeve, wherein the selectively shiftable piston is slidable between an engaged position in which the lock element is urged into contact with the latch section and a disengaged position in which the lock element is released from the latch section.

Embodiment 3. The downhole tool according to any prior embodiment, further comprising: a shear pin extending through the sleeve and selectively constraining movement of the shiftable piston.

Embodiment 4. The downhole tool according to any prior embodiment, wherein the lock element comprises a ball bearing.

Embodiment 5. The downhole tool according to any prior embodiment, wherein the latch section comprises an annular groove formed in the second surface portion.

Embodiment 6. The downhole tool according to any prior embodiment, wherein the sleeve includes an opening aligned with the selectively shiftable piston, the sleeve providing a pathway for an activation pressure holding the selectively shiftable piston in the engaged position.

Embodiment 7. The downhole tool according to any prior embodiment, wherein the lock support zone comprises an annular groove formed in the one of the first and second surfaces.

Embodiment 8. The downhole tool according to any prior embodiment, wherein the first surface comprises an outer surface of the mandrel and the second surface comprises an inner surface of the mandrel, and the first surface portion defines an outer surface portion of the sleeve and the second surface portion defines an inner surface portion of the sleeve.

Embodiment 9. The downhole tool according to any prior embodiment, further comprising: a travel limiter that prevents the selectively shiftable piston from moving beyond the disengaged position.

Embodiment 10. The downhole tool according to any prior embodiment, wherein the downhole tool includes at least one of an anchor and a packer element.

Embodiment 11. A resource exploration and recovery system comprising: a surface system; a subsurface system including a tubular string having a tool comprising: a mandrel including a first surface, and opposing second surface defining a flow path, a lock support zone provided on one of the first and second surfaces, and a passage extending between the flow path and the first surface, the tool being supported on one of the first and second surfaces; a sleeve selectively shiftable on the one of the first and second surfaces into engagement with the tool, the sleeve including a first surface portion and a second surface portion, the second surface portion including a latch section; and a lock system arranged between the first surface and the second surface portion in the lock support zone, the lock system including a lock member selectively supporting a lock element in the latch section, the lock element constraining movement of the sleeve.

Embodiment 12. The downhole tool according to any prior embodiment, wherein the lock member comprises a selectively shiftable piston arranged between the mandrel and the sleeve, wherein the selectively shiftable piston is slidable between an engaged position in which the lock element is urged into contact with the latch section and a disengaged position in which the lock element is released from the latch section.

Embodiment 13. The downhole tool according to any prior embodiment, further comprising: a shear pin extending through the sleeve and selectively constraining movement of the shiftable piston.

Embodiment 14. The downhole tool according to any prior embodiment, wherein the lock element comprises a ball bearing.

Embodiment 15. The downhole tool according to any prior embodiment, wherein the latch section comprises an annular groove formed in the second surface portion.

Embodiment 16. The downhole tool according to any prior embodiment, wherein the sleeve includes an opening aligned with the selectively shiftable piston, the sleeve providing a pathway for an activation pressure holding the selectively shiftable piston in the engaged position.

Embodiment 17. The downhole tool according to any prior embodiment, wherein the lock support zone comprises an annular groove formed in the one of the first and second surfaces.

Embodiment 18. The downhole tool according to any prior embodiment, wherein the first surface comprises an outer surface of the mandrel and the second surface comprises an inner surface of the mandrel, and the first surface portion defines an outer surface portion of the sleeve and the second surface portion defines an inner surface portion of the sleeve.

Embodiment 19. The downhole tool according to any prior embodiment, further comprising: a travel limiter that prevents the selectively shiftable piston from moving beyond the disengaged position.

Embodiment 20. The downhole tool according to any prior embodiment, wherein the downhole tool includes one of an anchor and a packer element.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole tool system comprising:

a mandrel including a first surface, and opposing second surface defining a flow path, a lock support zone provided one of the first and second surfaces, and a passage extending between the flow path and the first surface;

a tool supported on one of the first and second surfaces;

a sleeve selectively shiftable on the one of the first and second surfaces into engagement with the tool, the sleeve including a first surface portion and a second surface portion, the second surface portion including a latch section; and a lock system arranged between the first surface and the second surface portion in the lock support zone, the lock system including a lock member selectively supporting a lock element in the latch section, the lock element constraining movement of the sleeve, wherein the lock member comprises a selectively shiftable piston arranged between the mandrel and the sleeve, wherein the selectively shiftable piston is slidable between an engaged position in which the lock element is urged into contact with the latch section and a disengaged position in which the lock element is released from the latch section.

2. The downhole tool system according to claim 1, further comprising: a shear pin extending through the sleeve and selectively constraining movement of the shiftable piston.

3. The downhole tool system according to claim 1, wherein the lock element comprises a ball bearing.

4. The downhole tool system according to claim 1, wherein the latch section comprises an annular groove formed in the second surface portion.

5. The downhole tool system according to claim 1, wherein the sleeve includes an opening aligned with the selectively shiftable piston, the sleeve providing a pathway for an activation pressure holding the selectively shiftable piston in the engaged position.

6. The downhole tool system according to claim 1, wherein the lock support zone comprises an annular groove formed in the one of the first and second surfaces.

7. The downhole tool system according to claim 1, wherein the first surface comprises an outer surface of the mandrel and the second surface comprises an inner surface of the mandrel, and the first surface portion defines an outer surface portion of the sleeve and the second surface portion defines an inner surface portion of the sleeve.

8. The downhole tool system according to claim 1, further comprising: a travel limiter that prevents the selectively shiftable piston from moving beyond the disengaged position.

9. The downhole tool system according to claim 1, wherein the downhole tool includes at least one of an anchor and a packer element.

10. A resource exploration and recovery system comprising:

a surface system;

a subsurface system including a tubular string having a tool system comprising:

a mandrel including a first surface, and opposing second surface defining a flow path, a lock support zone provided on one of the first and second surfaces, and a passage extending between the flow path and the first surface;

a tool being supported on one of the first and second surfaces;

a sleeve selectively shiftable on the one of the first and second surfaces into engagement with the tool, the sleeve including a first surface portion and a second surface portion, the second surface portion including a latch section; and a lock system arranged between the first surface and the second surface portion in the lock support zone, the lock system including a lock member selectively supporting a lock element in the latch section, the lock element constraining movement of the sleeve, wherein the lock member comprises a selectively shiftable piston arranged between the mandrel and the sleeve, wherein the selectively shiftable piston is slidable between an engaged position in which the lock element is urged into contact with the latch section and a disengaged position in which the lock element is released from the latch section.

11. The resource exploration and recovery system according to claim 10, further comprising: a shear pin extending through the sleeve and selectively constraining movement of the shiftable piston.

12. The resource exploration and recovery system according to claim 10, wherein the lock element comprises a ball bearing.

13. The resource exploration and recovery system according to claim 10, wherein the latch section comprises an annular groove formed in the second surface portion.

14. The resource exploration and recovery system according to claim 10, wherein the sleeve includes an opening aligned with the selectively shiftable piston, the sleeve providing a pathway for an activation pressure holding the selectively shiftable piston in the engaged position.

15. The resource exploration and recovery system according to claim 10, wherein the lock support zone comprises an annular groove formed in the one of the first and second surfaces.

16. The resource exploration and recovery system according to claim 10, wherein the first surface comprises an outer surface of the mandrel and the second surface comprises an inner surface of the mandrel, and the first surface portion defines an outer surface portion of the sleeve and the second surface portion defines an inner surface portion of the sleeve.

17. The resource exploration and recovery system according to claim 10, further comprising: a travel limiter that prevents the selectively shiftable piston from moving beyond the disengaged position.

18. The resource exploration and recovery system according to claim 10, wherein the downhole tool includes one of an anchor and a packer element.

* * * * *